US006519435B2

(12) United States Patent
Park et al.

(10) Patent No.: US 6,519,435 B2
(45) Date of Patent: Feb. 11, 2003

(54) ELECTROSTATIC TRANSFER TYPE LIQUID ELECTROPHOTOGRAPHIC PRINTER

(75) Inventors: Mun-bae Park, Suwon-si (KR); Myung-ho Kyung, Suwon-si (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/953,287

(22) Filed: Sep. 17, 2001

(65) Prior Publication Data

US 2002/0110390 A1 Aug. 15, 2002

(30) Foreign Application Priority Data

Feb. 15, 2001 (KR) ..... 01-7608

(51) Int. Cl.[7] ..... G03G 15/10
(52) U.S. Cl. ..... 399/237; 399/239; 399/249
(58) Field of Search ..... 399/233, 237, 399/238, 239, 240, 249

(56) References Cited

U.S. PATENT DOCUMENTS 6,049,684 A * 4/2000 Nishikawa et al. ..... 399/249
6,308,034 B1 * 10/2001 Nakashima et al. ..... 399/249
6,418,288 B2 * 7/2002 Saitoh ..... 399/250

* cited by examiner

*Primary Examiner*—Hoan Tran
(74) *Attorney, Agent, or Firm*—Sughrue Mion, PLLC

(57) ABSTRACT

An electrostatic transfer type liquid electrophotographic printer using a photoreceptor web circulating around a continuous path as a photoreceptor medium is provided. The photoreceptor web is charged to a predetermined potential by a main charger and a plurality of latent electrostatic images is sequentially formed thereon by a plurality of laser scanning units (LSUs). A plurality of developer units are arranged in series in the circulation direction of the photoreceptor web, and sequentially develops the plurality of latent electrostatic images into multi-color toner images with inks containing a liquid carrier and charged toner, thereby forming overlapping multi-color toner images on the photoreceptor web. A concentration control unit controls the concentration of the multi-color toner images to be suitable for electrostatic transfer by adjusting the amount of the liquid carrier applied to the overlapping toner images formed on the photoreceptor web.

17 Claims, 12 Drawing Sheets

ELECTROSTATIC TRANSFER TYPE LIQUID ELECTROPHOTOGRAPHIC PRINTER

BACKGROUND OF THE INVENTION

1. Field of the Invention

The present invention relates to a liquid electrophotographic printer and, more particularly, to an electrostatic transfer type liquid electrophotographic printer adopting a photoreceptor web as a photoreceptor medium.

2. Description of the Related Art

Electrophotographic printers such as laser printers output a desired image by forming a latent electrostatic image on a photoreceptor medium such as a photoreceptor drum or electroreceptor web, and developing the latent electrostatic image with a predetermined color toner. Electrophotographic printers are classified into a dry type or liquid type according to the toner used. For the liquid type printer, which uses an ink containing liquid carrier and solid toner in a predetermined ratio, it is easy to implement a color image with excellent print quality, compared with the dry type printer which uses solid toner. Electrophotographic printers are classified into a press transfer type and electrostatic transfer type according to the toner image transfer manner. To the press transfer type, after drying a toner image, the dried toner image is hot pressed by a transfer roller such that the image is transferred to a printer paper. The electrostatic transfer type printer transfers a toner image to a print paper by electric force.

FIG. 1 shows an example of a conventional electrostatic transfer type liquid electrophotographic printer, which adopts photoreceptor drums 10*a*, 10*b*, 10*c* and 10*d* as photoreceptor media. As shown in FIG. 1, this printer has a plurality of image forming units 1*a*, 1*b*, 1*c* and 1*d* for developing and transferring a predetermined color image to a print paper P. For a color printer, the four image forming units 1*a*, 1*b*, 1*c* and 1*d* for a color image development and transfer are arranged in a line in the direction of transferring the print paper P such that toner images are sequentially developed into four colors, yellow (Y), magenta (M), cyan (C), and black (K) to form a multi-color image. Reference numeral 2 denotes a feed belt 2 for feeding the print paper P.

The image forming units 1*a*, 1*b*, 1*c* and 1*d* include photoreceptor drums 10*a*, 10*b*, 10*c* and 10*d* on the surface of which a latent electrostatic image is to be formed, main chargers 20*a*, 20*b*, 20*c* and 20*d* being installed adjacent to the corresponding photoreceptor drums 10*a*, 10*b*, 10*c* and 10*d* to charge the surfaces of the photoreceptor drums 10*a*, 10*b*, 10*c*, and 10*d* to a predetermined potential, and laser scanning units (LSUs) 30*a*, 30*b*, 30*c* and 30*d* which scan light beams onto the surfaces of the respective photoreceptor drums 10*a*, 10*b*, 10*c* and 10*d* to form a latent electrostatic image thereon. Development units 50*a*, 50*b*, 50*c* and 50*d* which develop the latent electrostatic images into toner images with a predetermined color ink are installed below the respective photoreceptor drums 10*a*, 10*b*, 10*c* and 10*d*. Transfer chargers 70*a*, 70*b*, 70*c* and 70*d* which transfer the developed toner images formed on the respective photoreceptor drums 10*a*, 10*b*, 10*c* and 10*d* to a print paper P by electric force are spaced a predetermined distance apart from the surface of the corresponding facing photoreceptor drums 10*a*, 10*b*, 10*c* and 10*d*.

The structure of the development units 50*a*, 50*b*, 50*c* and 50*d* will be described with reference to the development unit 50*a* for yellow (Y) toner image (referred to as Y-development unit 50*a*). Referring to FIG. 2, a developer roller 51, a squeeze roller 52 and a setting roller 53 are installed in the Y-development unit 50*a*. An ink supply unit 57 for supplying an ink to the developer roller 51 is installed adjacent to the developer roller 51. Scrapers 54, 55 and 56 are attached to the lower portion of the developer roller 51, the squeeze roller 52 and the setting roller 53, respectively, to scrap off the ink adhering to the surface of the corresponding rollers.

Development of a Y-toner image by the Y-development unit 50*a* having the configuration above will be described in greater detail. First, as the surface of the photoreceptor drum 10*a* charged to a predetermined potential by a main discharger 20*a* is irradiated by a light beam from the LSU 30*a*, a latent electrostatic image corresponding to the yellow color is formed. The developer roller 51 of the Y-development unit 50*a* rotates counterclockwise while being separated by a predetermined distance from the photoreceptor drum 10*a*. As an ink is supplied to the rotating developer roller 51 from the ink supply unit 57, the ink is carried to the gap between the photoreceptor drum 10*a* and the developer roller 51 by the rotation of the developer roller 51. The toner particles of the ink adhere to the latent electrostatic image formed on the photoreceptor drum 10*a*, so that a toner image is formed. At this time, the surface of the developer roller 51 is charged to a predetermined development potential such that the toner selectively adheres to only the latent electrostatic image, not to a non-image region.

The squeeze roller 52 removes excess liquid carrier from the photoreceptor drum 10*a* while being separated by a predetermined distance from the photoreceptor drum 10*a* and rotating clockwise.

The setting roller 53 rotates counterclockwise while being separated by a predetermined distance from the photoreceptor drum 10*a*, and creates an electric field between the photoreceptor drum 10*a* and the setting roller 53 with application of a predetermined voltage. The binding force between toner particles becomes strengthened by the electric field produced between the setting roller 53 and the photoreceptor drum 10*a*. Adhesiveness of the toner image to the photoreceptor drum 10*a* also increases. As a result, although an excessive amount of liquid carrier remains on the surface of the photoreceptor drum 10*a* for a subsequent electrostatic transfer, the shape and location of the toner image can be kept intact.

Once the toner image is set by the setting roller 53, the toner image is transferred to a print paper P by the electric field produced by the transfer charger 70*a* to which a potential is applied such that the transfer charger 70*a* is charged to the opposite polarity to the toner.

After a Y-toner image is transferred to the print paper P by the Y-image forming unit 1*a*, a magenta (M)-toner image is developed and transferred to the print paper P by the M-image forming unit 1*b*.

As previously described, four toner images in Y, M, C and K are sequentially transferred to a predetermined area on the print paper P feed by a feed belt 2 in accordance with the print paper feed rate, so that a color image is printed on the print paper P. Because a large amount of liquid carrier remains on the resulting color image, a drying process is performed by a drying unit (not shown).

The conventional electrostatic transfer type liquid electrophotographic printer having the configuration described above has the following problems. First, since the conventional printer uses four photoreceptor drums as photoreceptor media, each for a particular color toner image, the multi-color toner images on the four photoreceptor drums must be sequentially transferred to a moving print paper with a predetermined time gap. The respective color toner images are separately transferred, and thus it is difficult to accurately transfer each of the color toner images in a particular area on the print paper in accordance with the print paper feed rate. In other words, an accurate registration control on the development and transfer processes performed by each image forming unit is difficult.

Second, four toner image transfer processes are carried out on a print paper feed by a feed belt, so that the print paper contacts the liquid carrier adhering to the surface of the photoreceptor drums four times. As a result, unnecessary consumption of the liquid carrier increases and the wetness of the print paper also increases.

Third, because the squeeze roller removes liquid carrier in a non-contact manner with respect to the photoreceptor drums, the amount of the liquid carrier remaining on the surface of the photoreceptor drums is nonuniform for all the image forming units. As a result, toner image transfer efficiency differs from color to color.

SUMMARY OF THE INVENTION

To address the above limitations, it is an object of the present invention to provide an electrostatic transfer type liquid electrophotographic printer which uses a photoreceptor web circulating around a continuous path as a photoreceptor medium.

To achieve the objective of the present invention, there is provided an electrostatic transfer type liquid electrophotographic printer comprising: a photoreceptor web circulating around a continuous path; a main charger for charging the surface of the photoreceptor web to a predetermined potential; a plurality of laser scanning units (LSUs) for sequentially forming a plurality of latent electrostatic images by scanning a light beam onto the charged surface of the photoreceptor web; a plurality of developer units arranged in series in the circulation direction of the photoreceptor web, for sequentially developing the plurality of latent electrostatic images into multi-color toner images with inks containing a liquid carrier and charged toner, thereby forming overlapping multi-color toner images on the photoreceptor web; a concentration control unit for controlling the concentration of the multi-color toner images to be suitable for electrostatic transfer by adjusting the amount of the liquid carrier applied to the overlapping toner images formed on the photoreceptor web; and an electrostatic transfer unit for forming an electric field between the photoreceptor web and the same and transferring the overlapping toner images formed on the photoreceptor web to a print paper by electric force.

In one embodiment, the concentration control unit may be installed in the last development unit of the plurality of the development units. It is preferable that the concentration control unit may be a concentration control belt rotating by being supported by at least two rollers while being separated by a predetermined distance from the photoreceptor web. Alternatively, the concentration control unit may be a concentration control roller having a diameter two times larger than the diameter of the developer roller, and rotating while being separated by a predetermined distance from the photoreceptor web.

In another embodiment, the concentration control unit may be spatially separated from the plurality of development units. In this case, the concentration control unit may include a carrier reservoir for storing a liquid carrier, and the concentration control belt or concentration control roller as described previously. The concentration control unit may further comprise a carrier supply nozzle for supplying the liquid carrier into the gap between the photoreceptor web and the concentration control belt. The concentration control belt and the concentration control roller allow the liquid carrier supplied into the gap between the photoreceptor web, and the concentration control belt and the concentration control roller to permeate into the toner images formed on the photoreceptor web.

The electrostatic transfer type electrophotographic printer according to the present invention may further comprise a setting roller for setting the shapes of the toner images formed on the photoreceptor web, wherein the surface of the setting roller is charged to a potential having the same polarity as the toner. It is preferable that the setting roller is installed while being separated from the photoreceptor web to the extent that the setting roller does not contact the liquid carrier layer on the photoreceptor web.

As the electrostatic transfer unit, an electrostatic transfer roller rotating in contact with the photoreceptor web, or a transfer charger installed facing to the photoreceptor web while being separated by a predetermined distance from the photoreceptor web may be used. A predetermined voltage, for example, of −900V—2 kV, having an opposite polarity to the toner, is applied to the electrostatic transfer roller and the transfer charger.

It is preferable that the electrostatic transfer type liquid electrophotographic printer further comprises a preconditioning unit for cleaning the surface of the photoreceptor web and forming a liquid carrier layer on the surface before development of the toner images.

According to the present invention, a color image can be obtained by sequentially forming multi-color toner images on the surface of the photoreceptor web, such that the toner images overlap each other. The multi-color toner images can be transferred to a print paper P by just one transfer process. Thus, registration in developing and transferring multi-toner images can be easily controlled. Also, wetness of the print paper and liquid carrier consumption decrease.

BRIEF DESCRIPTION OF THE DRAWINGS

The above object and advantages of the present invention will become more apparent by describing in detail preferred embodiments thereof with reference to the attached drawings, in which.

DETAILED DESCRIPTION OF THE PREFERRED EMBODIMENTS

An electrostatic transfer type liquid electrophotographic printer according to the present invention now will be described more fully with reference to the accompanying drawings, in which preferred embodiments of the invention are shown. This invention may, however, be embodied in many different forms and should not be construed as being limited to the embodiments set forth herein; rather, these embodiments are provided so that this disclosure will be thorough and complete, and will fully convey the concept of the invention to those skilled in the art.

Figure 1:
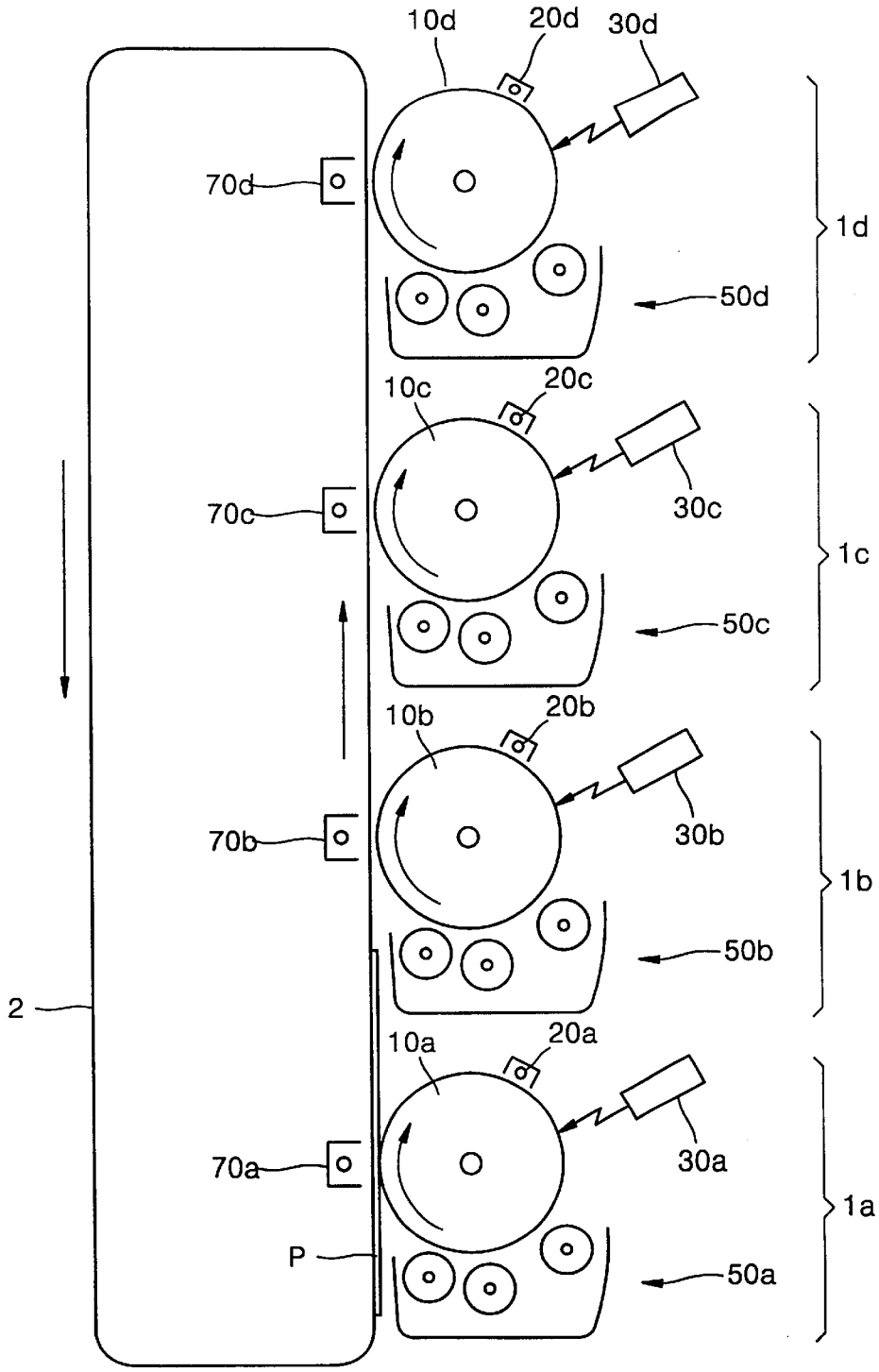
FIG. 1 (PRIOR ART)
FIG. 1 is a schematic view showing the structure of an example of a conventional electrostatic transfer type liquid electrophotographic printer.
Figure 2:
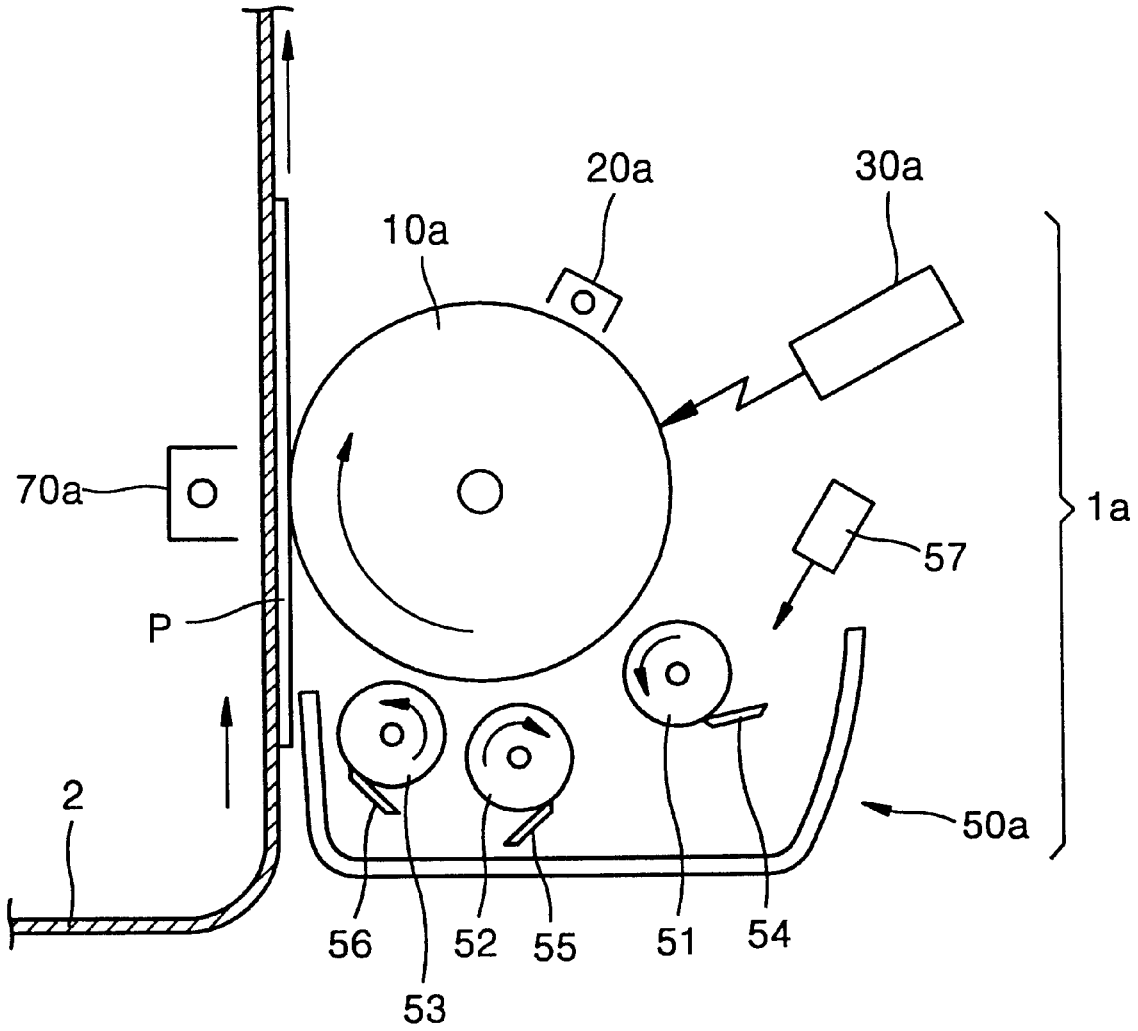
FIG. 2 (PRIOR ART)
FIG. 2 is a detailed view of a development unit of FIG. 1.
Figure 3:
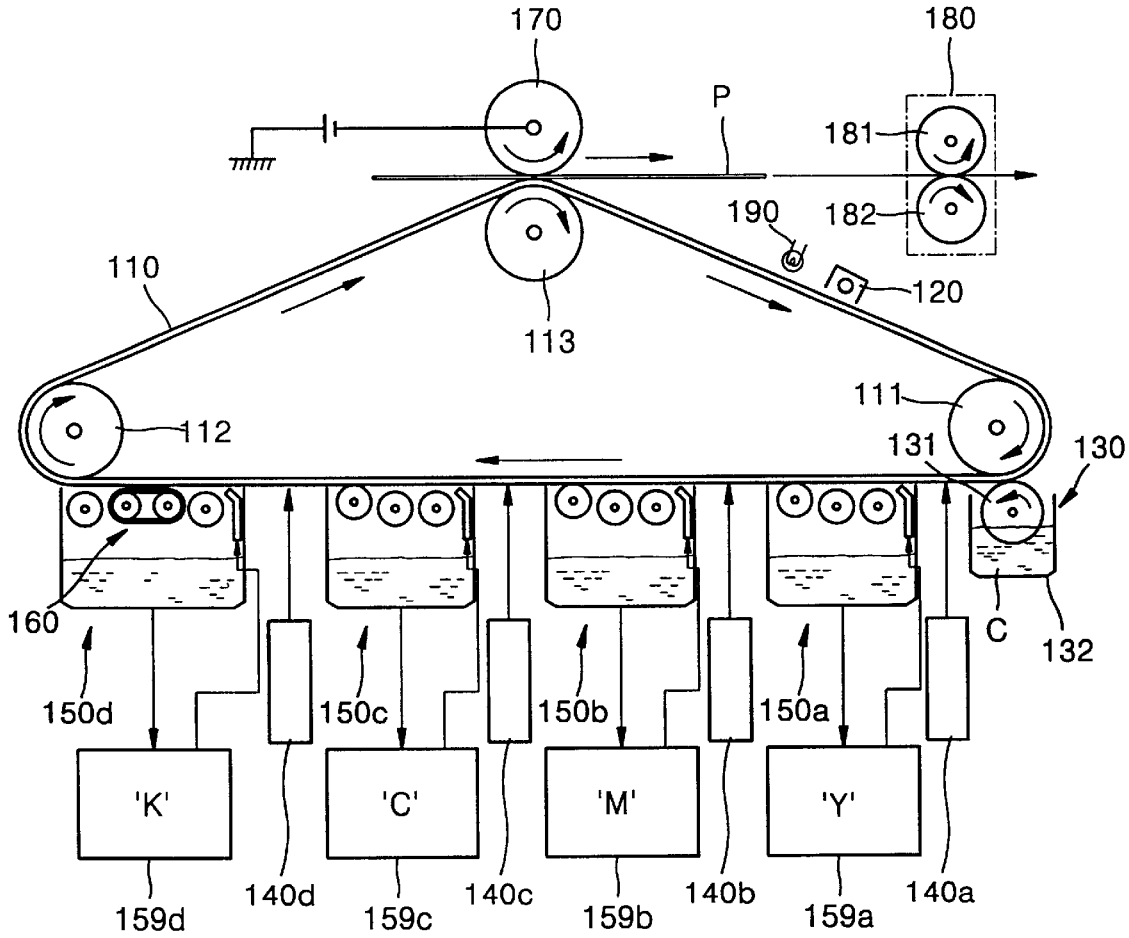
FIG. 3 is a schematic view of an embodiment of an electrostatic transfer type liquid electrophotographic printer according to the present invention.

The configuration of an embodiment of an electrostatic transfer type liquid electrophotographic printer according to the present invention is shown in FIG. 3. As shown in FIG. 3, the electrostatic transfer type liquid electrophotographic printer utilizes a photoreceptor web 110 as a photoreceptor medium. The photoreceptor web 110 circulates around a continuous path by being supported by three rollers 111, 112 and 113 including a driving roller and a steering roller. A main charger 120 is provided adjacent to the photoreceptor web 110 to uniformly charge the photoreceptor web 110 to a predetermined potential.

Laser scanning units (LSUs) 140*a*, 140*b*, 140*c* and 140*d* for scanning light beams onto the charged photoreceptor web 110 to form a latent electrostatic image, and development units 150*a*, 150*b*, 150*c* and 150*d* for developing the latent electrostatic image as a toner image with a predetermined color ink are provided below the photoreceptor web 110. To form a multi-color image, for example, four color toner images of yellow (Y), magenta (M), cyan (C) and black (B), four LSUs 140*a*, 140*b*, 140*c* and 140*d*, and four development units 150*a*, 150*b*, 150*c* and 150*d* are provided so that four color toner images are sequentially formed, overlapping each other, and developed into a multi-color image. The four development units 150*a*, 150*b*, 150*c* and 150*d* are arranged below the photoreceptor web 110, in series in a circulation direction of the photoreceptor web 110. The structure and operation of the development units 150*a*, 150*b*, 150*c* and 150*d* will be described later in greater detail. In a lower portion of the respective development units 150*a*, 150*b*, 150*c* and 150*d*, ink reservoirs 159*a*, 159*b*, 159*c* and 159*d* which contain Y, M, C and K inks, respectively, are provided. In the inks contained in the ink reservoirs 159*a*, 159*b*, 159*c* and 159*d*, toner charged to a predetermined polarity is dispersed in a liquid carrier. The concentration of ink is in the range of 2.0–3%, and preferably, 2.5%. The term "concentration" in this specification refers to the weight percentage of toner with respect to ink or toner image. Although the toner can be charged to positive or negative potential, the description below will be limited to the toner charged to the positive potential. Also, the four color toner images may be developed in the order of Y, C, M and K.

A concentration control unit 160 for controlling the concentration of toner images to be suitable for an electrostatic transfer process, which will be described later, by adjusting the amount of the liquid carrier of the overlapping toner images formed on the photoreceptor web 110 is provided. To form a distinct color image by the electrostatic transfer of the toner images formed on the photoreceptor web 110 to a print paper P, there is a need to control the concentration of the toner images before the transfer process such that the fluidity of the toner increases. As a result of the experiments, more than 99% transfer efficiency is achieved at a concentration of 20–40%. Transfer efficiency means the percentage of the toner images transferred from the photoreceptor web 110 to a print paper P. If the toner concentration exceeds 40%, the electrostatic transfer process cannot be performed smoothly due to reduced fluidity of the toner, thereby lowering transfer efficiency. If the toner concentration is below 20% by weight, i.e., if the liquid carrier content is too high, toner image leaking may occur on the print paper P due to highly increased fluidity of the toner. In addition, it is very likely that the toner images cannot be kept intact before being transferred to a print paper.

Toner images are sequentially developed by the four development units 150*a*, 150*b*, 150*c* and 150*d* on the surface of the photoreceptor web 110, so that a toner image formed earlier may be washed off during the development by the ink applied thereon to form a toner image of another color. To prevent this washing-off, there is a need to form a toner image formed earlier with a high toner concentration of, for example, 50%. However, it is very likely that filming of the toner image occurs by the high concentration toner images. Filming refers to the formation of a thin gel film caused by aggregation of toner particles in the toner images. The transfer efficiency becomes lower by this filming.

Accordingly, the concentration control unit 160 increases the fluidity of toner by supplying a sufficient amount of light carrier to an early developed toner image, so that filming of the toner image can be prevented. The concentration control unit 160 controls the toner concentration of the overlapping toner images to be in the range of 20–40% for satisfactory electrostatic transfer. The structure and operation of the concentration control unit 160 will be described later.

The toner images developed on the surface of the photoreceptor web 110, whose toner concentration has been adjusted to be suitable for electrostatic transfer, are transferred to a print paper P by an electrostatic transfer unit. The electrostatic transfer unit forms an electric field between the photoreceptor web 110 and the electrostatic transfer unit such that the toner images formed on the photoreceptor web 110 are transferred to the print paper P by the electric force. As shown in FIG. 3, an electrostatic transfer roller 170 may be used as the electrostatic transfer unit. The electrostatic transfer roller 170 rotates in a circulation direction of the photoreceptor web 110 while being in contact with the photoreceptor web 110, and the print paper P is fed between the electrostatic transfer roller 170 and the photoreceptor web 110. To create an electric field, a predetermined voltage of −900V—2 kV is applied to the electrostatic transfer roller 170. The electrostatic transfer roller 170, at least the surface thereof, is formed of a resistive material having a high resistance of $10^8$–$10^9$ Ω, for example, of urethane rubber. The reason that a voltage having the opposite polarity to the toner is applied to the electrostatic transfer roller 170 is to attract the toner such that a toner image can be transferred to the print paper P.

Figure 4:
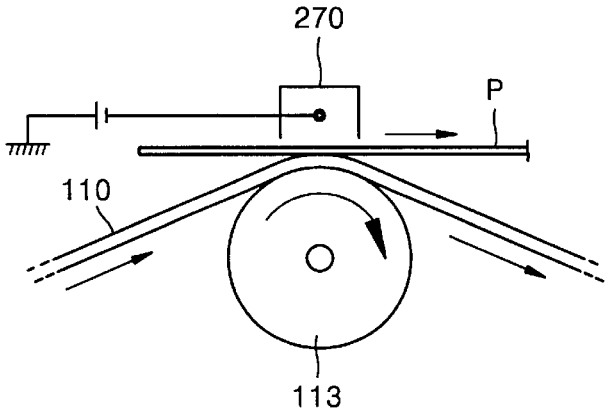
FIG. 4 is a view of another example of the electrostatic transfer unit of FIG. 3.

Alternatively, a transfer charger 270, as shown in FIG. 4, may be used as the electrostatic transfer unit. The transfer charger 270 is disposed facing the photoreceptor web 110 while being separated by a predetermined distance from the surface of the photoreceptor web 110. A print paper P passes between the transfer charger 270 and the photoreceptor web 110. A predetermined voltage of −900V—2 kV is applied to the transfer charger 170. As a result, the toner images on the surface of the photoreceptor web 110 can be transferred to the print paper P, as described previously.

Turning back to FIG. 3, a fusing unit 180 for fusing the toner images transferred to the print paper P may be provided at the paper eject side of the electrostatic transfer roller 170. The fusing unit 180 may include two fusing rollers 181 and 182 rotating in contact with each other. The two fusing rollers 181 and 182 fix the toner images on the print paper P, which passes between the fixing rollers 181 and 182, by hot pressing. Reference numeral 190 denotes an eraser for removing the remaining latent electrostatic images from the surface of the photoreceptor web 110.

The electrostatic transfer type liquid electrophotographic printer according to the present invention may further include a pre-conditioning unit 130 for cleaning the photoreceptor web 110 and forming a liquid carrier film on the surface of the photoreceptor web 110 before development of toner images. The pre-conditioning unit 130 includes a pre-conditioning roller 131 rotating in contact with the photoreceptor web 110, and a pre-conditioning vessel 132 which contains a liquid carrier C to be supplied to the pre-conditioning roller 131. A lower portion of the preconditioning roller 131 is immersed in the liquid carrier C to allow the liquid carrier to adhere the surface of the preconditioning roller 131. As the pre-conditioning roller 131 rotates, the liquid carrier C contained in the pre-conditioning vessel 131 is transferred to the surface of the photoreceptor web 110 and forms a thin film thereon. As a result, filming of an early formed toner image on the surface of the photoreceptor web 110 can be retarded.

Hereinafter, the development units 150*a*, 150*b*, 150*c* and 150*d*, and the concentration control unit 160 will be described in greater detail. In the embodiment illustrated in FIG. 3, the three development units 150*a*, 150*b* and 150*c*, exclusive of the K-development unit 150*d* (a development unit for black (K)), have the same structure. The concentration control unit 160 is installed in the K-development unit 150*d*. The structure of the three development units 150*a*, 150*b* and 150*c*, which are the same, will be described first with reference to the Y-development unit 150*a* (a development unit for yellow) of FIG. 5.

Figure 5:
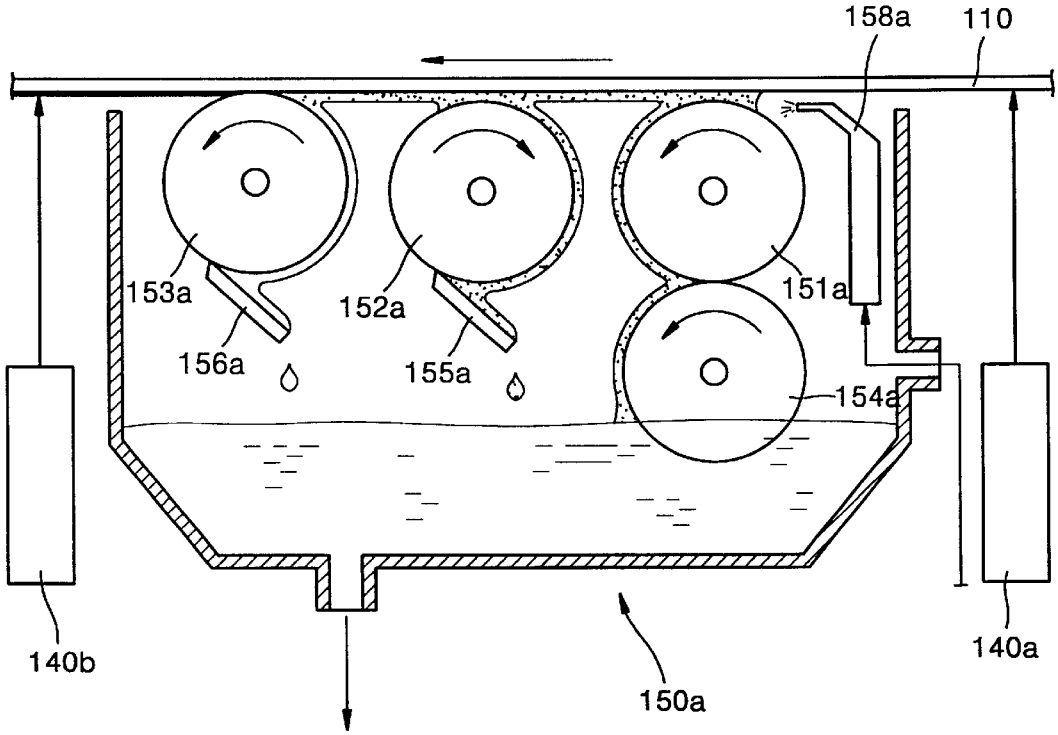
FIG. 5 is a detailed view of the structure of a development unit of FIG. 3.

Referring to FIG. 5, three rollers including a developer roller 151*a*, a toner removal roller 152*a*, and a squeeze roller 153*a* are installed in an upper portion of the Y-development unit 150*a*. The electrostatic transfer type liquid electrophotographic printer according to the present invention employs the development system that uses three rollers 151*a*, 152*a* and 153*a*. The developer roller 151*a* makes the toner particles of the ink to adhere to the latent electrostatic images formed in an image region of the photoreceptor web 110 to form toner images. The toner removal roller 152*a* removes the toner adhering to the non-image region of the photoreceptor web 110. To end this, a predetermined voltage is applied to the toner removal roller 152*a*. This will be described later. The squeeze roller 153*a* presses a portion of the photoreceptor web 110 in which toner images are formed to squeeze excess liquid carrier from the portion, thereby aggregating the toner particles forming the toner images. A relatively high voltage is applied to the squeeze roller 153*a* such that the photoreceptor web 110 can be charged by the squeeze roller 153*a* to a predetermined potential for another color toner image development. To end this, the squeeze roller 153*a*, at least the surface thereof, is formed of a resistive material with a high resistance of $10^5$–$10^7$ Ω, and preferably, $10^6$ Ω, for example, of urethane rubber.

An ink supply nozzle 158*a* is installed adjacent to the developer roller 151*a*. The ink supply nozzle 158*a* supplies the ink contained in the Y-ink reservoir 159*a* (see FIG. 3) in the gap between the photoreceptor web 110 and the developer roller 151*a*. A cleaning roller 154*a* rotating in contact with the developer roller 151*a* is installed below the developer roller 151*a*. The cleaning roller 154*a* removes the ink adhering to the surface of the developer roller 151. A blade 155*a* is disposed underneath the toner removal roller 152*a* while its one end is in contact with the surface of the toner removal roller 152*a*. A blade 156*a* is disposed underneath the squeeze roller 153*a* while its one end is in contact with the surface of the squeeze roller 153*a*. The two blades 155*a* and 156*a* act to remove the ink or liquid carrier adhering to the surface of the toner removal roller 152*a* and the squeeze roller 153*a*, respectively. As the cleaning means, the cleaning roller 154*a* and the blades 155*a* and 156*a* are interchangeable. Both a cleaning roller and a blade may be installed for each of the rollers 151*a*, 152*a* and 153*a*.

Figure 6:
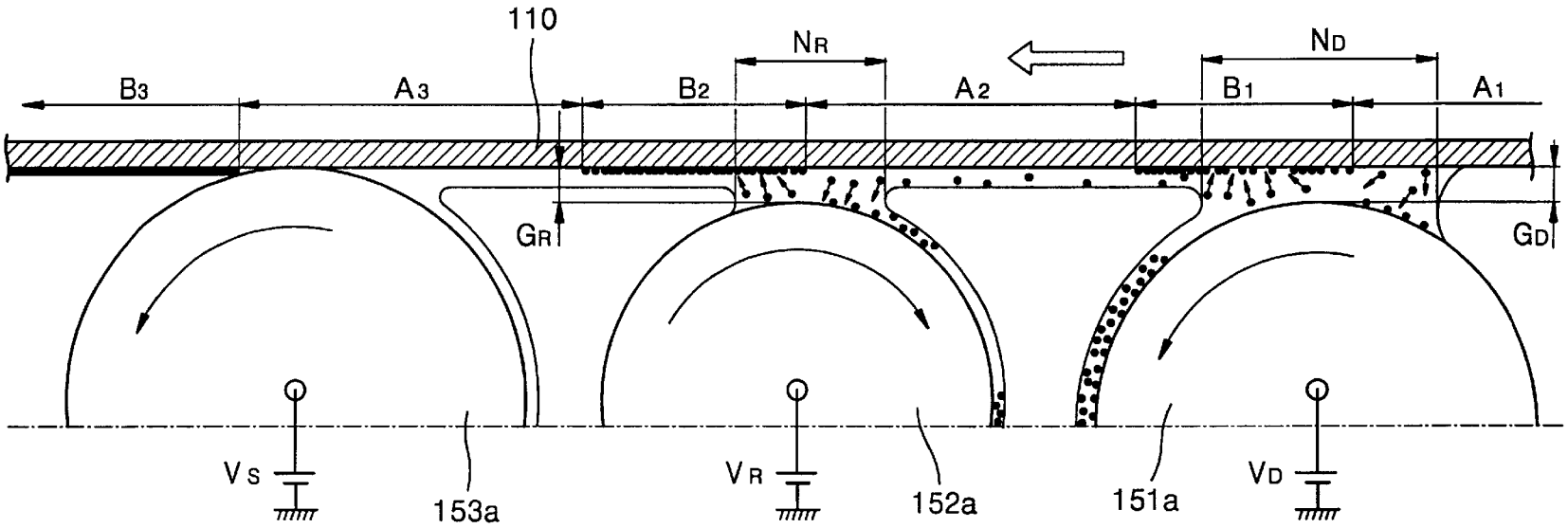
FIG. 6 is a partial detailed view of the development unit of FIG. 3 for illustrating the development process in the liquid electrophotographic printer according to the present invention.

Development of a latent electrostatic image into a toner image by the Y-development unit 150*a* having the configuration described previously will be described with reference to FIG. 6. The photoreceptor web 110 is charged by the main charger 120 to a potential (referred to as a charge potential), for example, of 500–600 volts, and preferably, 550 volts, having the same polarity as the toner. The charged surface of the photoreceptor web 110 is irradiated by a light beams from the Y-LSU (LSU for yellow) 140*a* such that a latent electrostatic image corresponding to yellow color is formed. The Y-LSU 140*a* selectively discharges the surface of the photoreceptor web 110 to form a latent electrostatic image, so that a potential $V_{BY}$ Of the image region $B_1$, in which the latent electrostatic image is formed, drops to about 100 volts or less (referred to as exposure potential), while a potential $V_A$ of the non-image region $A_1$ is maintained at the initial charge potential charged by the main charger 120.

The latent electrostatic image is developed into a Y-toner image by the Y-development unit 150*a*. In particular, as the photoreceptor web 110 passes over the developer roller 151, Y-toner adheres to the image region $B_1$, in which an electrostatic latent image is formed, to form a Y-toner image. As a predetermined voltage is applied to the developer roller 151*a*, the surface of the developer roller 151*a* is charged to a development potential $V_D$ of about 350 volts. The development potential $V_D$ of the development roller 151*a* is determined to be lower than the discharge potential (550 V) of the non-image region $A_1$, and to be higher than the exposure potential (100 V) of the image region $B_1$. It is preferable that differences between the development potential $V_D$ and each of the charge potential and the exposure potential are 100 volts or more, and preferably, 200 volts or more. As the potential differences become greater, the affinity of toner particles to the photoreceptor web 110 and the developer roller 151 a becomes more apparent. The developer roller 151*a* rotates in the circulation direction of the photoreceptor web 110 while being separated by a development gap $G_D$ of 150–200 μm from the photoreceptor web 110. As the ink containing Y-toner of about 2.5% by weight, which is contained in the Y-ink reservoir 159*a*, is supplied by the ink supply nozzle 158*a*, a nip $N_D$ as a liquid carrier film having about 6-mm width is formed between the photoreceptor web 110 and the developer roller 151*a*.

The toner particles of the ink are charged to positive potential and move in the nip $N_D$ as follows. The exposure potential $V_{BY}$ (100 volts) in the image region $B_1$ of the photoreceptor web 110 is lower than the development potential $V_D$ (350 volts) of the development roller 151*a*, so that the toner particles move towards the image region $B_1$ and adheres to the image region $B_1$. The charge potential $V_A$ (500 volts) in the non-image region $A_1$ is greater than the development potential $V_D$ (350 volts) of the developer roller 151*a*, so that the toner particles move towards the developer roller 151*a* and adhere to the developer roller 151*a*. In other words, the toner particles selectively adhere to only the image region $B_1$ charged to a relatively low potential, so that toner images are formed therein. Excess ink and toner particles stuck to the surface of the developer roller 151*a* are removed by the cleaning roller 154 rotating in contact with the developer roller 151*a*.

On the image region $B_2$ corresponding to the image region $B_1$ passed through the developer roller 151*a*, an ink layer to be a high-concentration toner image is formed and covered with a liquid carrier layer. On the non-image region $A_2$, only a liquid carrier layer is formed. In the image region $B_2$ passed through the developer roller 151, the potential $V_{BY}$ increases to about 160 voltes. The potential $V_A$ in the non-image region $A_2$ drops to about 380 volts. It is desirable that no toner remains in the liquid carrier layers passed through the developer roller 151*a*. In actuality, about 0.5% by weight toner remains in the liquid carrier layers. The remaining toner particles are transferred to the M-development unit 150*b* along the photoreceptor web 110, and mixed with toner of another color. As a result, the M-development unit 150*b*, C-development unit 150*c*, and K-development unit 150*d*, which are sequentially arranged, and the inks for each color are contaminated by the transfer of toner particles. Thus, there is a need to fully remove the toner particles remaining in the liquid carrier layers.

The toner particles remaining in the liquid carrier layers are removed by the toner removal roller 152*a* disposed adjacent to the developer roller 151*a*. As the photoreceptor web 110 passes the toner removal roller 152*a*, toner particles remaining in the liquid carrier layer in the non-image region $A_2$ are removed, thereby resulting in a toner-free liquid carrier layer in the non-image region $A_2$. In particular, the surface of the toner removal roller 152*a* is charged to a toner removal potential $V_R$ of about 250 volts with application of a predetermined voltage. The toner removal potential $V_R$ of the toner removal roller 152*a* is determined to be greater than the exposure potential $V_{BY}$ (160 volts) in the image region $B_2$ and lower than the potential $V_A$ (380 volts) in the non-image region $A_2$. As a potential difference in each region becomes greater, it is much easier to remove the toner particles from the liquid carrier layer. The toner removal roller 152*a* is installed with a gap $G_R$ of about 150–200 $\mu$m from the photoreceptor web 110. A nip $N_R$ having a width of 3–5-mm is formed between the toner removal roller 152*a* and the photoreceptor web 110. The width of the nip $N_R$ may be varied depending on the diameter of the toner removal roller 152*a* and the size of the gap $G_R$. Although the toner removal roller 152*a* can rotate in any direction, it is preferable that the toner removal roller 152 rotates in an opposite direction to the circulation direction of the photoreceptor web 110 for easier formation of the nip $N_R$.

In the nip $N_R$ formed between the photoreceptor web 110 and the toner removal roller 152*a*, the toner particles move as follows. In the non-image region $A_2$ of the photoreceptor web 110, the potential $V_A$ (380 volts) is higher than the toner removal potential $V_R$ (250 volts) of the toner removal roller 152*a*, so that toner particles dispersed in the liquid carrier layer move towards the toner removal roller 152*a*. The potential $V_{BY}$ (160 volts) in the image region $B_2$ is lower than the toner removal potential $V_R$ (250 volts) of the toner removal roller 152*a*, so that the toner particles move towards the image region $B_2$ and adhere to a previously formed toner image. As the toner removal roller 152*a* rotates, the toner particles and liquid carrier adhering to the surface of the toner removal roller 152*a* are removed by the blade 155*a*.

As described previously, the toner particles existing in the liquid carrier layer on the non-image region $A_2$ can be almost completely removed by the toner removal roller 152*a*, so that a toner-free liquid carrier remains in the non-image region $A_3$ of the photoreceptor web 110 passed through the toner removal roller 152*a*. As a result, the problem of toner transfer to the adjacent development unit can be solved.

As the photoreceptor web 110*a* passes the squeeze roller 153*a*, the toner image region of the photoreceptor web 110*a* is pressed by the squeeze roller 153*a*, so that excess liquid carrier is squeezed from the toner image. In particular, the squeeze roller 153*a* rotates in the circulation direction of the photoreceptor web 110 in contact with the photoreceptor web 110 with a compression force, for example, of about 10 kgf. As a result, the liquid carrier covering the toner image in the image region $B_3$ of the photoreceptor web 110, and the liquid carrier adhering to the non-image region $A_3$ are removed such that just an appropriate amount of the liquid carrier remains therein. Once the photoreceptor web 110 passes the squeeze roller 153*a*, a toner image is formed as an ink layer containing about 50% by weight toner in the image region $B_3$ of the photoreceptor web 110. The liquid carrier stuck to the surface of the squeeze roller 153*a* is removed by the blade 156*a* and recovered into the Y-ink reservoir 159*a*. The reason that the concentration of the toner image is increased is to protect the toner image from being washed off by the ink applied to the same to form a toner image in another color.

The squeeze roller 153*a* also acts to charge the photoreceptor web 110 again to a predetermined potential to develop a toner image in another color. To this end, a relatively high voltage is applied to the squeeze roller 153*a* such that the surface of the squeeze roller 153*a* is charged to a squeeze potential $V_S$ of about 800 volts or more, which is higher than the charge potential. Thus, once the photoreceptor web 110 passes the squeeze roller 153*a*, the potential $V_A$ in the non-image region $A_3$ of the photoreceptor web 110 and the potential $V_{BY}$ in the image region $B_3$ are equal to or higher than the charge potential, to allow development of a toner image of another color.

Because the surface of the squeeze roller 153*a* is charged to a relatively high potential, a toner image is formed in the image region $B_3$ by the repulsive force exerted between the squeeze roller 153*a* and the toner particles, and firmly adheres to the image region $B_3$ with increased binding force of the toner particles. As a result, no thinning of the toner image at its edges occurs by the pressing of the squeeze roller 153*a*. In addition, washing-off of the toner image by an ink applied to form another toner image does not occur, so that the shape and location of the toner image can be maintained intact.

After a Y-toner image is formed through the steps described above, to develop a toner image of magenta (M), the surface of the photoreceptor web 110 is irradiated by a light beam from the M-LSU 140*b* so that a latent electrostatic image corresponding to a M-toner image is formed. This latent electrostatic image has a potential of about 100 volts, and is developed into a M-toner image by the M-development unit 150*b* in the same manner as for the Y-toner image, as described previously. Next, a toner image of cyan (C) is developed by the C-development unit 150*c*.

After toner images are developed in three colors including Y, M and C, a black (K) toner image is developed by the K-development unit 150*d*. The concentration of the overlapping toner images previously formed on the photoreceptor web 110 is adjusted to be suitable for electrostatic transfer by the K-development unit 150*d*.

Figure 7A:
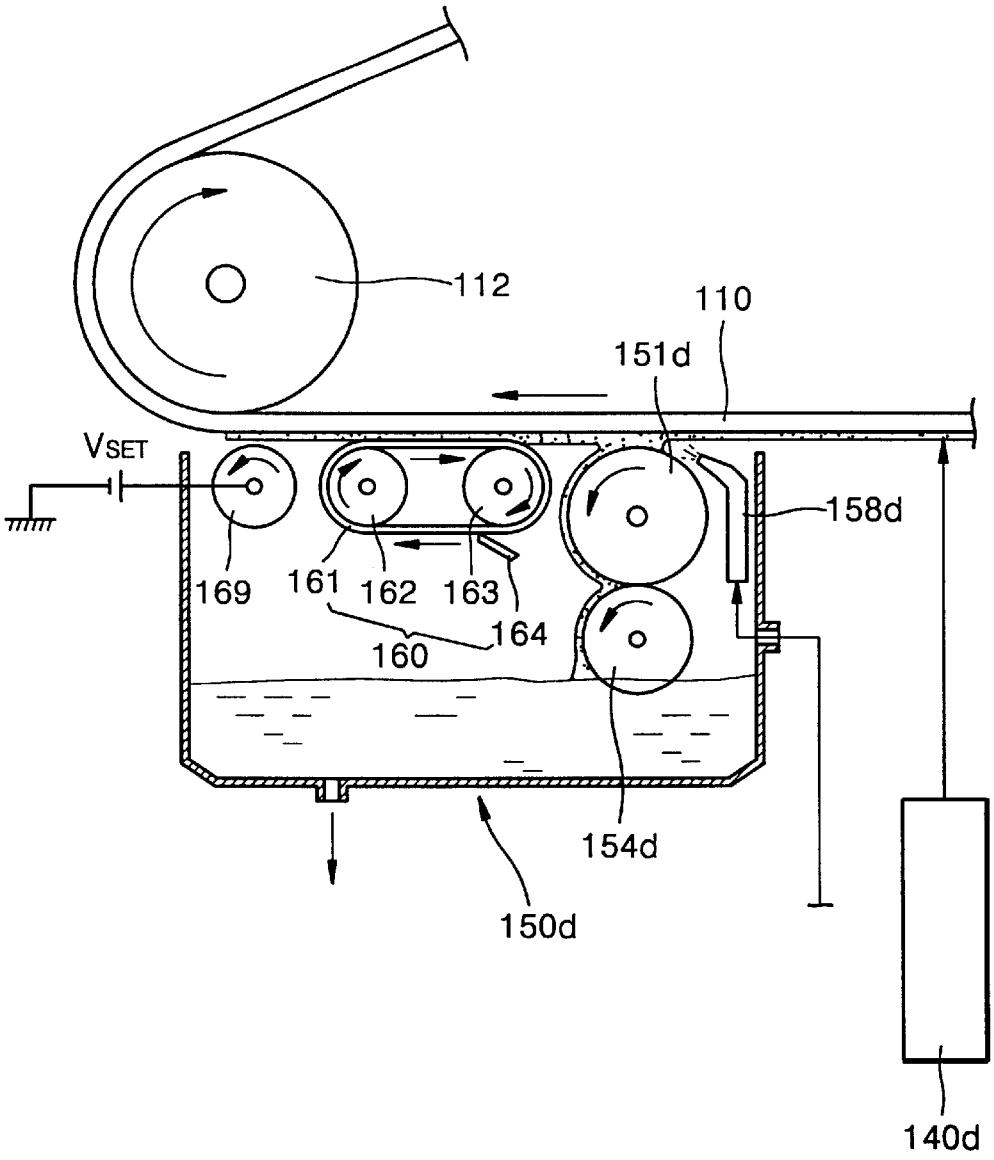
FIG. 7A is a view of the structure of the concentration control unit of FIG. 3.
Figure 7B:
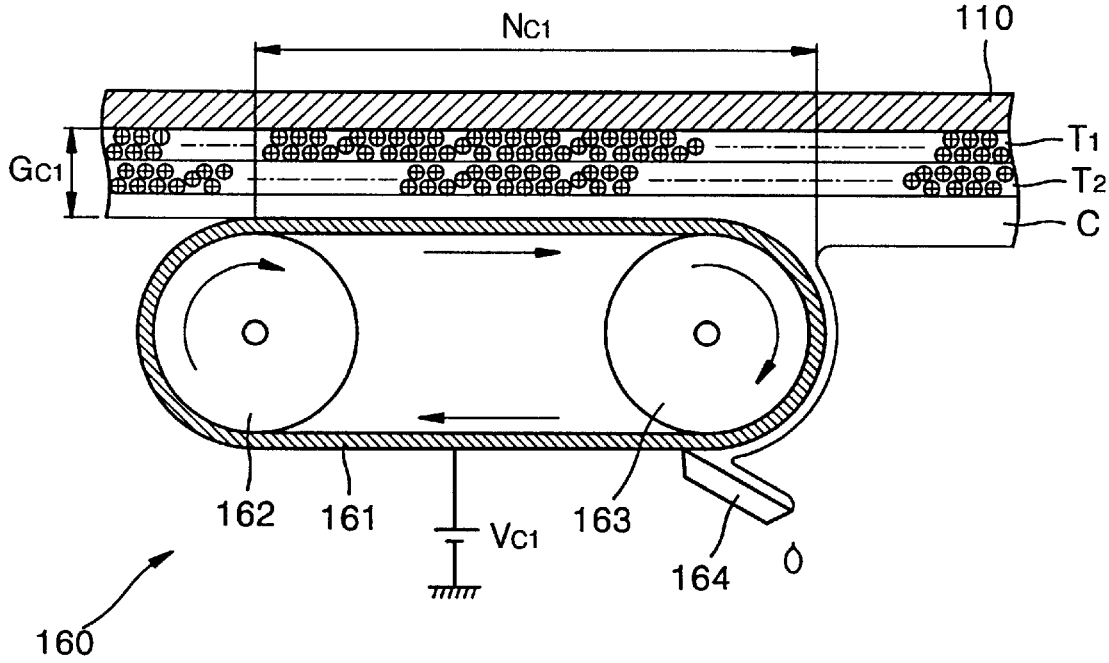
FIG. 7B is a detailed view illustrating the function of the concentration control unit of FIG. 7A.

Referring to FIGS. 7A and 7B, a developer roller 151*d* and an ink supply nozzle 158*d* are installed in an upper portion of the K-development unit 150*d*. The ink supply nozzle 158*d* supplies the ink contained in the K-ink reservoir 159*d* (see FIG. 3) in the gap between the photoreceptor web 110 and the developer roller 151*d*. The developer roller 151*d* develops a latent electrostatic image corresponding to K color, which is formed on the photoreceptor web 110 by the K-LSU 140*d*, into the K-toner image with the ink. A cleaning roller 154*d* for removing the ink stuck to the surface of the development roller 151*d* is installed underneath the development roller 151*d*.

As the concentration control unit 160, a concentration control belt 161 circulating by being supported by two rollers 162 and 163 is installed in the K-development unit 150*d*. The concentration control belt 161 is installed while being separated by a gap $G_{C1}$ of 50–100 $\mu$m from the photoreceptor web 110. The gap $G_{C1}$ is determined to be smaller than the development gap $G_D$ of 150–200 $\mu$m. It is preferable that the traveling direction of the concentration control belt 161 is opposite to that of the photoreceptor web 110 such that the liquid carrier layer C passed through the concentration control belt 161 becomes as thin as possible with uniformity. The distance between the two rollers 162 and 163 is determined such that the nip $N_{C1}$ formed between the concentration control belt 161 and the photoreceptor web 110 has a width of 15 mm or more, preferably, of 20–30 mm. The reason that the nip $N_{C1}$ is formed in such a wide width is to allow liquid carrier to uniformly permeate into the toner images for a sufficient period of time.

In general, multi-color toner images are formed as two overlapping layers $T_1$ and $T_2$ (first and second toner image layers) on the surface of the photoreceptor web 110 through the development process described previously. To implement a full color image, there is a need to mix two or three colors of Y, M, C and K. Usually, a full color image can be implemented by mixing two colors. This is the reason why the two overlapping layers $T_1$ and $T_2$ are formed through the development process. The first toner image layer $T_1$ is first developed on the surface of the photoreceptor web 110, and the second toner image $T_2$ is formed on the first toner image layer $T_1$. As previously described, the first and second toner image layers $T_1$ and $T_2$ formed by the development process have a toner concentration of about 50%. In particular, for the first toner image layer $T_1$ which undergoes a few cycles of development because it is formed earlier than other layers, the toner concentration of the first toner image layer $T_1$ might further increase. For an electrostatic transfer of toner images, there is a need to control the toner concentration of the first and second toner image layers $T_1$ and $T_2$, for example, in the range of 20–40% by weight. In particular, a sufficient amount of liquid carrier is required for the first toner image layer $T_1$, such that filming of the first image layer $T_1$, which is described previously, can be prevented.

The concentration control belt 161 basically performs the following two functions. As the photoreceptor web 110 passes the developer roller 151*d* of the K-development unit 150*d*, a liquid carrier layer C is formed on the second toner image layer $T_2$. Because the K-development unit 150*d* has no toner removal roller and squeeze roller, which are included in the other development units, the liquid carrier layer C retains a relatively large amount of liquid carrier. On the other hand, the gap $G_{C1}$ between the photoreceptor web 110 and the concentration control belt 161 is smaller than the development gab $G_D$, so that excess amount of the liquid carrier is removed for optimum electrostatic transfer as the photoreceptor web 110 passes the concentration control belt 161. The removed liquid carrier is carried by being stuck to the surface of the concentration removal belt 161, and is removed by a blade 164 from the surface of the concentration control belt 161.

In the nip $N_{C1}$ formed between the photoreceptor web 110 and the concentration control belt 161, the liquid carrier remaining on the second toner image layer $T_2$ permeates into the second and first toner image layers $T_2$ and $T_1$. Because the width of the nip $N_{C1}$ is relatively large, the liquid carrier can infiltrate deeply into the first toner image layer $T_1$. As a result, the concentration of the first toner image layer $T_1$ as well as the second toner image layer $T_2$ becomes lower to 20–40% by weight so that electrostatic transfer can be smoothly performed with increased fluidity of the toner. The concentration of the overlapping toner images formed on the photoreceptor web 110 is uniformly adjusted by the concentration control belt 161, so that all the color toner images can be transferred with the same efficiency.

A predetermined voltage may be applied to the surface of the concentration control belt 161 so that the surface is charged to a first potential $V_{C1}$. The first potential $V_{C1}$ of the concentration control belt 161 is determined to be higher than the potential in the image region of the photoreceptor web 110 passed through the developer roller 151*d*. When the surface of the concentration control belt 161 is charged to a predetermined first potential $V_{C1}$, the toner particles firmly adhere to the surface of the photoreceptor web 110 by a repulsive force exerted between the concentration control belt 161 and the toner particles of the first and second toner image layers $T_1$ and $T_2$. As a result, although the liquid carrier is sufficiently supplied for the concentration adjustment, the shape of the toner images remains intact.

The K-development unit 150*d* may further include a setting roller 169. The setting roller 169 is spatially separated from the photoreceptor web 110 to the extent that it does not contact the liquid carrier layer C on the photoreceptor web 110. The surface of the setting roller 169 is charged to a predetermined second potential $V_{SET}$ with application of a voltage. The second potential $V_{SET}$ of the setting roller 169 is determined to be higher than the potential in the image region of the photoreceptor web passed through the concentration control belt 161. The setting roller 169 serves to keep the shape and location of the overlapping toner images on the photoreceptor web 110, thereby increasing the sharpness of the images transferred to a print paper P.

Figure 8A:
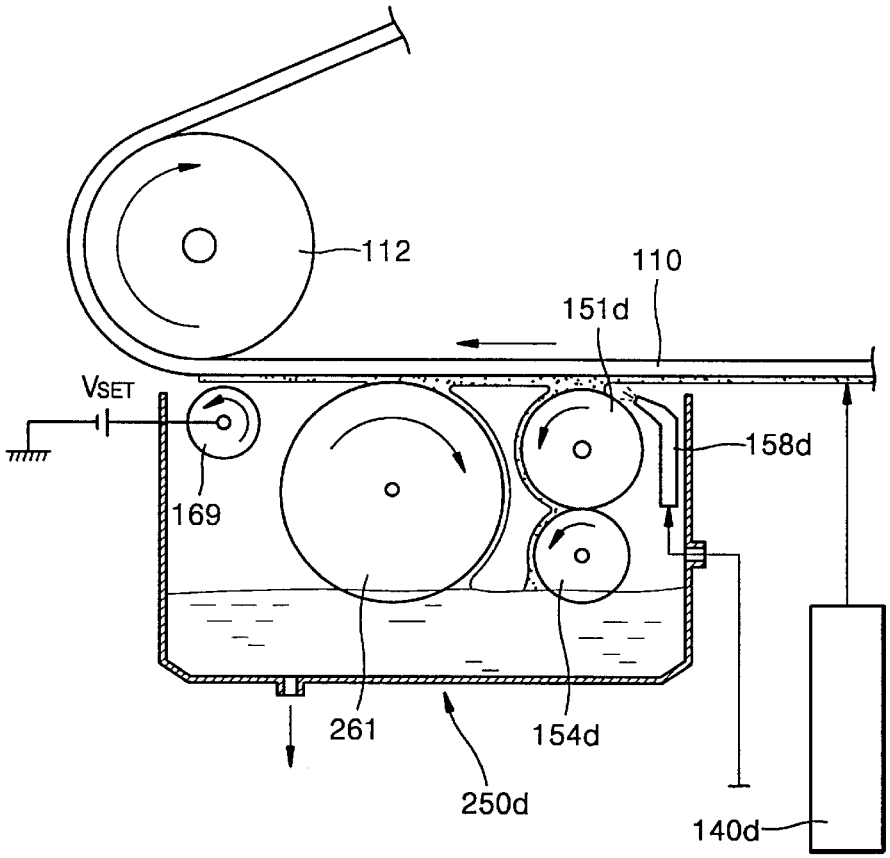
FIG. 8A is a view of another example of the concentration control unit of FIG. 3.
Figure 8B:
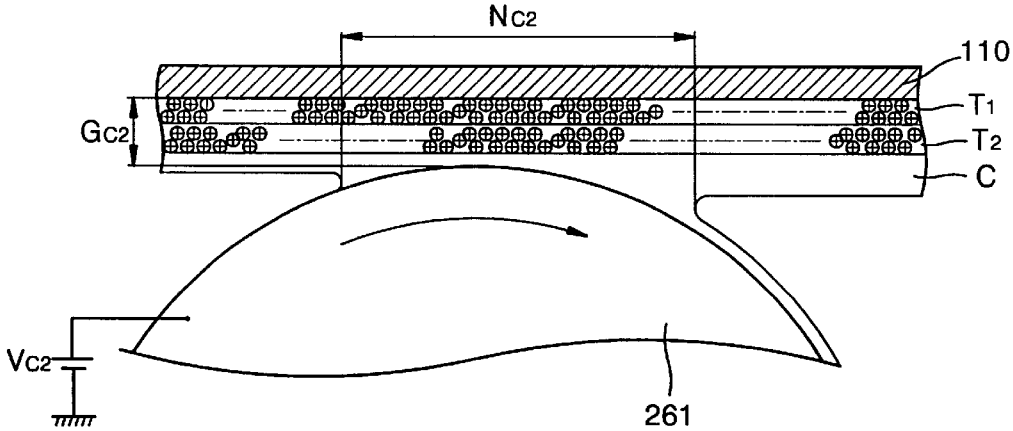
FIG. 8B is a detailed view illustrating the function of the concentration control unit of FIG. 8A.

Another example of the concentration control unit of FIG. 3 is illustrated in FIGS. 8A and 8B. Referring to FIGS. 8A and 8B, a developer roller 151*d*, an ink supply nozzle 158*d* and a cleaning roller 154*d* are installed in the K-development unit 250*d*. In the present embodiment, as a concentration control unit, a concentration control roller 261 having a relatively large diameter is installed in the K-development unit 250*d*. The concentration controller roller 261 is installed to be capable of rotating while being separated by a gap $G_{C2}$ of 50–100 $\mu$m from the photoreceptor web 110. The gap $G_{C2}$ is determined to be smaller than the development gap $G_D$, as described previously. It is preferable that the concentration control roller 261 rotates in a direction opposite to the circulation direction of the photoreceptor web 110 for the same reason described as in the previous embodiment. It is preferable that the diameter of the concentration control roller 261 is two times larger than that of the developer roller 151*d*. The concentration control roller 261 has a diameter of 50 mm or more, more preferably, of 60–70 mm. The diameter of the concentration control roller 261 is determined such that the nip $N_{C2}$ formed between the photoreceptor web 110 and the concentration control roller 261 has a width of 10 mm or more, more preferably, of 15–20 mm. The nip $N_{C2}$ having a relative large width allows the liquid carrier to sufficiently and uniformly permeate into the toner images. The surface of the concentration control roller 261 may be charged to a predetermined first potential $V_{C2}$ with application of a voltage. Like the K-development unit 150*d* described in the previous embodiment, the setting roller 169 charged to a predetermined second potential $V_{SET}$ may be installed in the K-development unit 250*d*.

Operation of the concentration control roller 261 is almost the same as the concentration control belt 161 described in the previous embodiment, and thus the operation of the concentration control roller 261 will be described briefly below. As the photoreceptor web 110 passes the developer roller 151*b* of the K-development unit 250*d*, a liquid carrier layer C that contains an excessive amount of liquid carrier is formed on the surface of the second toner image layer $T_2$. The excessive amount of the liquid carrier is removed by the concentration control roller 261 such that an appropriate amount of the liquid carrier for optimum electrostatic transfer remains in the liquid carrier layer C. In the nip $N_{C2}$ formed between the concentration control roller 251 and the photoreceptor web 110, the remaining liquid carrier permeates into the second and first toner image layers $T_2$ and $T_1$. The nip $N_{C2}$ is wide enough such that the liquid carrier permeates up to the first toner image layer $T_1$ for a period of time. As a result, the concentration of the first toner image layer $T_1$ as well as the second toner image layer $T_2$ is lower to 20–40% by weight with increased fluidity of the toner, so that an optimum electrostatic transfer can be achieved. Since the surface of the concentration control roller 261 is charged to a predetermined first potential $V_{C2}$, the toner particles firmly adhere to the photoreceptor web 110, so that the shapes of the toner images remain intact through the concentration control process.

Figure 9A:
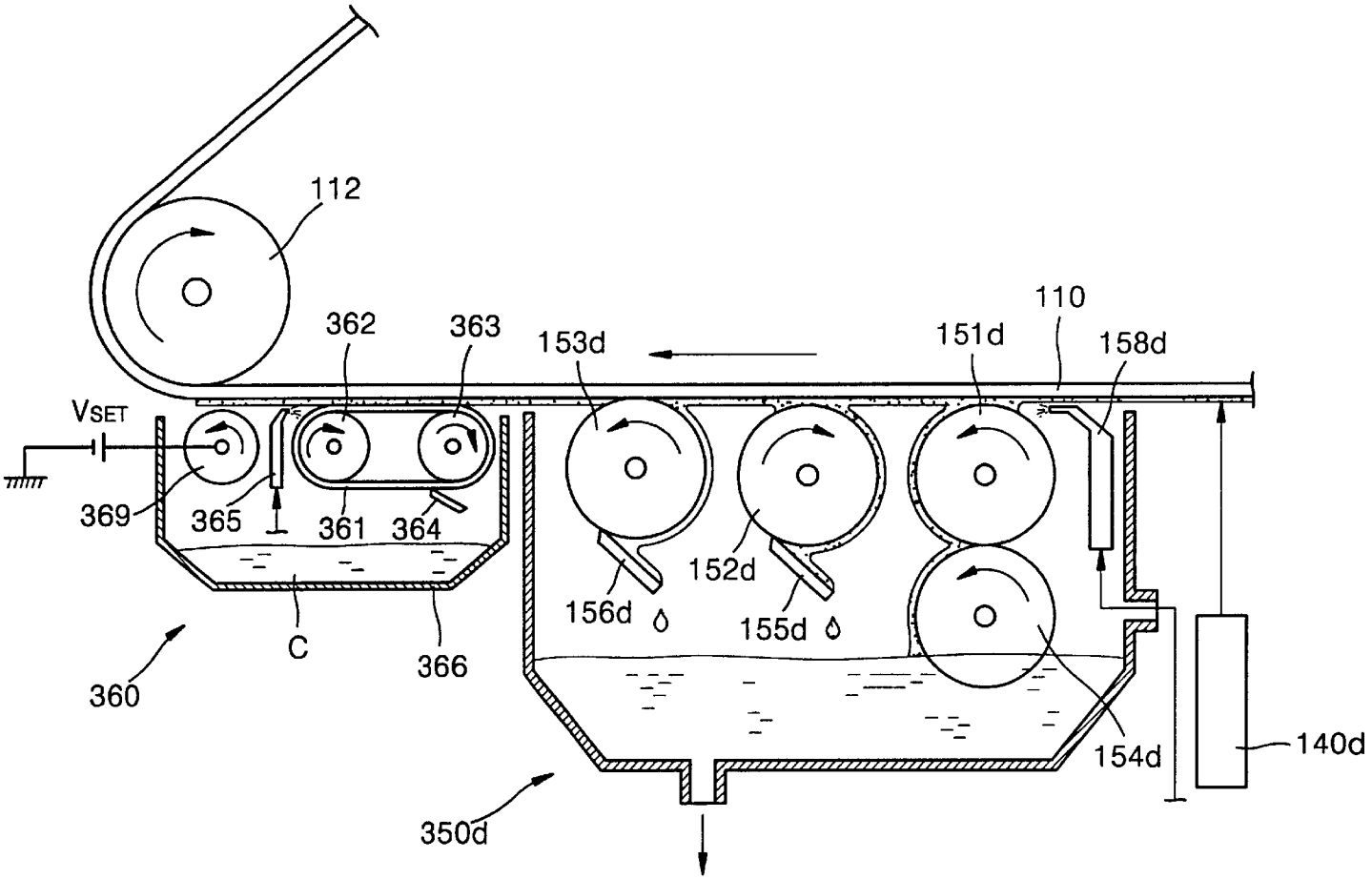
FIG. 9A is a view of another embodiment of an electrostatic transfer type liquid electrophotographic printer according to the present invention.
Figure 9B:
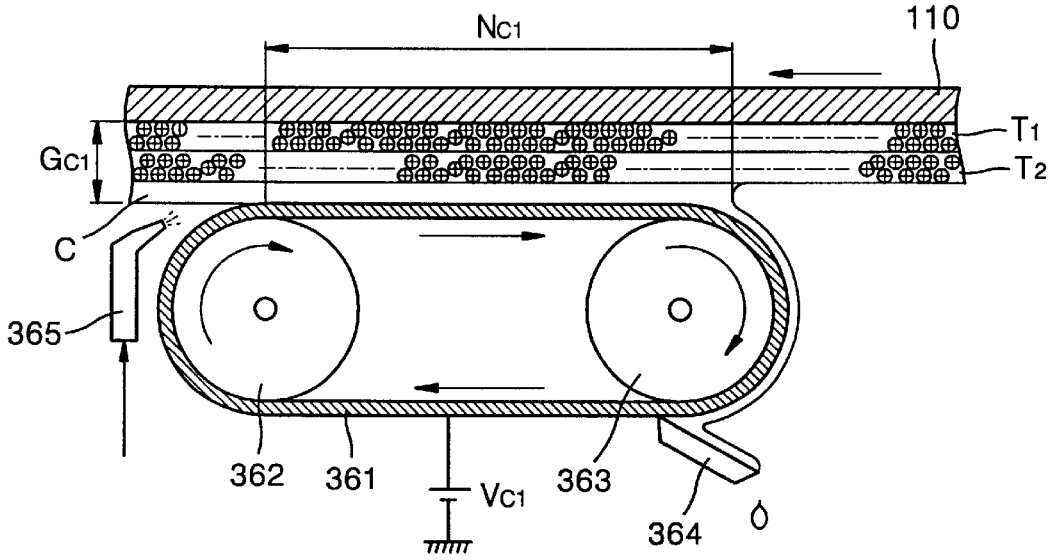
FIG. 9B is a detailed view illustrating the function of the concentration control unit of FIG. 9A.

FIGS. 9A and 9B are partial views of an electrostatic transfer type liquid electrophotographic printer according to another preferred embodiment of the present invention. The same elements as those of the previous embodiment of the liquid electrophotographic printer will not provided here. The elements denoted by the same reference numerals as those of the previous embodiment represents the same elements. Referring to FIGS. 9A and 9B, a concentration control unit 360 is installed out of the K-development unit 350*d*. Accordingly, like the other development units, the K-development unit 350*d* just develops a toner image. The concentration of the toner image is controlled by the separate concentration control unit 360.

Three rollers including a developer roller 151*d*, a toner removal roller 152*d* and a squeeze roller 154*d* are installed in an upper portion of the K-development unit 350*d*. An ink supply nozzle 158*d* is disposed adjacent to the development roller 151*d*, and a cleaning roller 153, which rotates in contact with the developer roller 151*d*, is installed underneath the developer roller 151*d*. Blades 155*d* and 156*d* are provided underneath the toner removal roller 152*d* and the squeeze roller 153*d*, respectively. These elements of the K-development unit 350*d* are the same and perform the same operations as those of the Y-development unit 150*a* described with reference to FIG. 5, and thus detailed descriptions thereof will not provided here.

The concentration control unit 360 includes a carrier reservoir 366 for storage of a liquid carrier C, and a concentration control belt 361 circulating by being supported by two rollers 362 and 363 in the carrier reservoir 366. A blade 364 may be provided underneath the concentration control belt 361 to remove liquid carrier from the surface of the concentration control belt 361, wherein one end of the blade 364 is in contact with the surface of the concentration control belt 361. A setting roller 369 discharged to a predetermined potential $V_{SET}$ may be installed in the carrier reservoir 366. The function of the setting roller 369 is the same as the setting roller 169 described in the previous embodiment.

The concentration control belt 361 is installed while being separated by a gap $G_{C1}$ of 50–100 $\mu$m from the photoreceptor web 110, and circulates in an opposite direction to the circulation direction of the photoreceptor web 110. The gap $G_{C1}$ is determined to be smaller than the development gap $G_D$, for example, in the range of 150–200 $\mu$m. The distance between the two rollers 362 and 363 is determined such that the nip $N_{C1}$ formed between the concentration control belt 361 and the photoreceptor web 110 has a width of 15 mm or more, preferably, of 20–30 mm. The liquid carrier layer $N_{C1}$ with a relatively large width allows the liquid carrier to sufficiently and uniformly permeate into the toner images for a period of time.

During the development process, multi-color toner images are formed as two overlapping layers $T_1$ and $T_2$ on the surface of the photoreceptor web 110. Unlike the previous embodiment, the K-development unit 350*d* includes a toner removal roller 152*d* and a squeeze roller 153*d*, so that excess liquid carrier does not remain on the surface of the second toner image layer $T_2$ formed on the photoreceptor web 110 passed through the K-development unit 350*d*. To perform an optimum electrostatic transfer process, there is a need to reduce the concentration of the first and second toner image layers $T_1$ and $T_2$ having a relatively high toner concentration of about 50% by supplying liquid carrier thereto. To end this, a carrier supply nozzle 365 for supplying liquid carrier in the gap between the photoreceptor web 110 and the concentration control belt 361 is provided. As the liquid carrier is supplied between the photoreceptor web 110 and the concentration control belt 361, the nip $N_{C1}$ is formed between the photoreceptor web 110 and the concentration control belt 361. In the nip $N_{C1}$, the liquid carrier permeates into the second and first toner image layers $T_2$ and $T_1$ for a sufficient period of time. As a result, the concentration of the second toner image layer $T_2$ as well as the first toner image layer $T_1$ becomes lower to 20–40% by weight suitable for optimum electrostatic transfer with increased fluidity of the toner. Instead of using the separate carrier supply nozzle 365, the concentration control belt 361 can be set such that its bottom surface is dipped into the liquid carrier contained in the carrier reservoir 366. In this case, the liquid carrier adheres to the surface of the concentration control belt 261 and is transferred to the second and first toner images $T_2$ and $T_1$ formed on the photoreceptor web 110.

The surface of the concentration control belt 361 may be charged to a predetermined first potential $V_{C1}$. In this case, the toner particles of the first and second toner image layers $T_1$ and $T_2$ strongly adhere to the photoreceptor web 110, so that even though sufficient liquid carrier is supplied during a concentration control process, the shapes of the toner images remain intact.

Figure 10A:
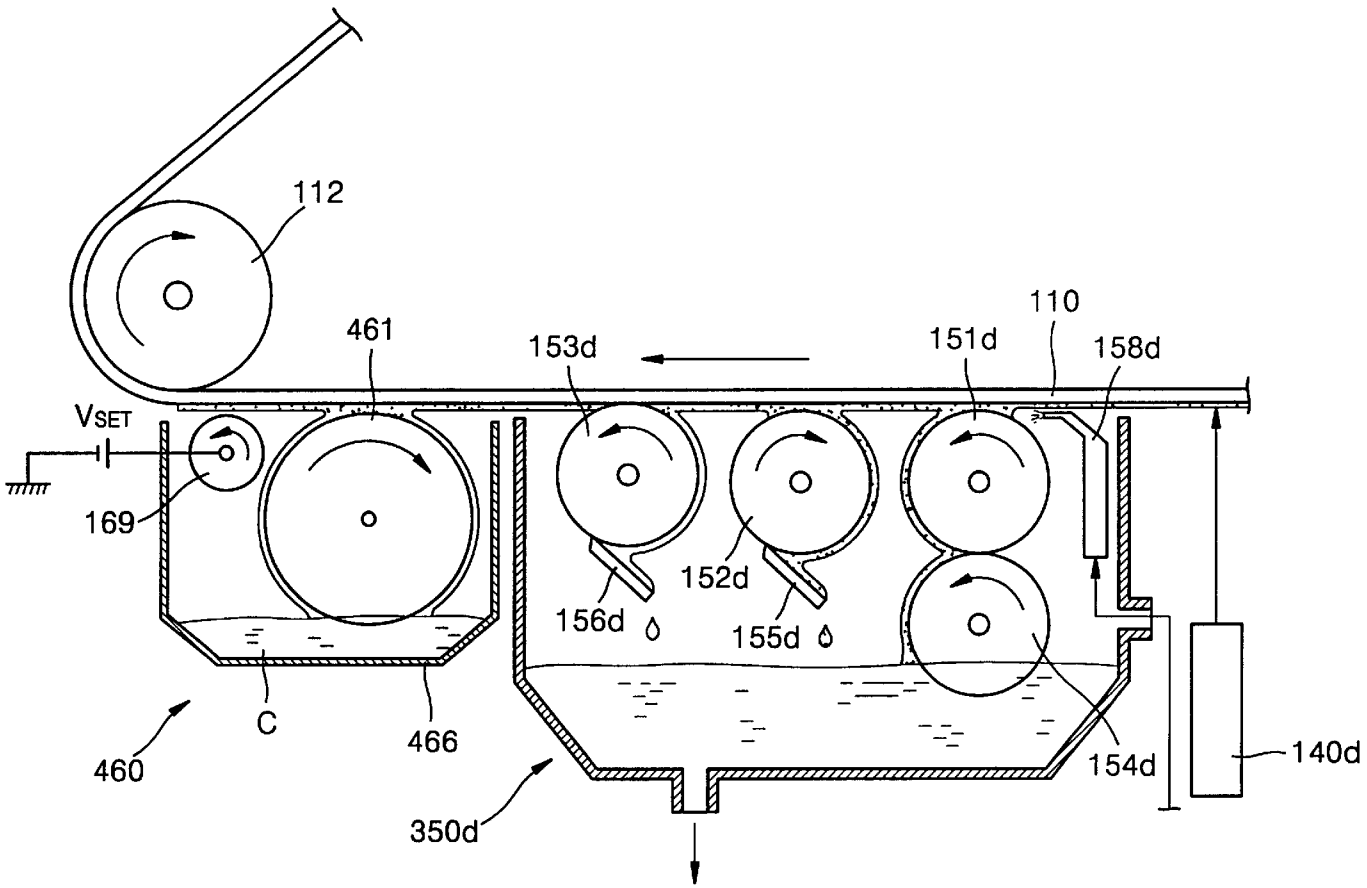
FIG. 10A is a view of another example of the concentration control unit of FIG. 9A.
Figure 10B:
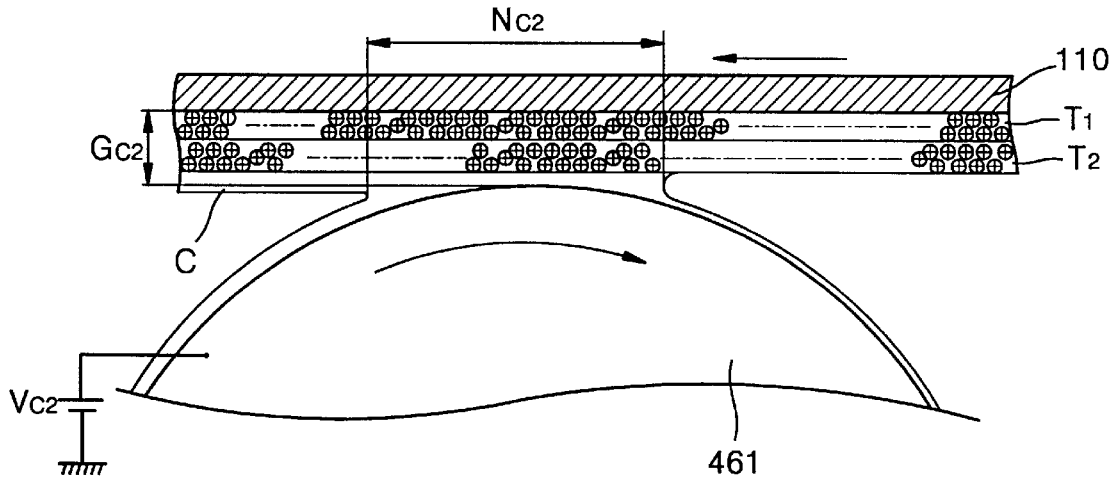
FIG. 10B is a detailed view illustrating the function of the concentration control unit of FIG. 10A.

FIGS. 10A and 10B show a modification of the concentration control unit of FIGS. 9A and 9B. Referring to FIGS. 10A and 10B, the structure of the K-development unit 350*d* is the same as that of FIG. 9A. The concentration control unit 460 includes a carrier reservoir 466 for storage of a liquid carrier C, and a concentration control roller 461 having a relatively large diameter, which is installed in the carrier reservoir 466. The concentration control roller 461 is separated from the photoreceptor web 110 by a predetermined gap $G_{C2}$ of 50–100 $\mu$m. The concentration control roller 461 is installed such that it can rotate in an opposite direction to the circulation direction of the photoreceptor web 110. The gap $G_{C2}$ is determined to be smaller than the development gap $G_D$, as described previously. It is preferable that the diameter of the concentration control roller 461 is two times larger than the diameter of the developer roller 151*d*. The concentration control roller 461 has a diameter of 50 mm or more, preferably, of 60–70 mm. The diameter of the concentration control roller 461 is determined such that the nip $N_{C2}$ formed between the concentration control roller 461 and the photoreceptor web 110 has a width of 10 mm, preferably, of 15–20 mm. The nip $N_{C2}$ with a relatively large width allows the liquid carrier to sufficient and uniformly permeate into the toner images. The surface of the concentration control roller 461 may be charged to a predetermined first potential $V_{C2}$ with application of a voltage. Like the previous embodiment, a setting roller 169 charged to a predetermined second potential $V_{SET}$ may be installed in the concentration control unit 460.

Function of the concentration control roller 461 is the same as that of the concentration control belt 361 described in the previous embodiment, and thus a detailed description thereof will not provided here. According to the present embodiment, there is a need to supplement liquid carrier so as to effectively reduce the concentration of the first and second toner image layers $T_1$ and $T_2$ for optimum electrostatic transfer. To achieve this, a lower portion of the concentration control roller 461 is dipped into the liquid carrier C contained in the carrier reservoir 466 for continuous supply of the liquid carrier C. As the concentration control roller 461 rotates, the liquid carrier contained in the carrier reservoir 466 forms a nip $N_{C2}$ between the concentration control roller 461 and the photoreceptor web 110. In the nip $N_{C2}$, the liquid carrier C permeates into the second and first toner image layer $T_2$ and $T_1$ for a period of time. As a result, the concentration of the first toner image layer $T_1$ as well as the second toner image layer $T_2$ is controlled to be suitable for electrostatic transfer of the toner images. As described with reference to FIG. 9A, the carrier supply nozzle 461 for supplying liquid carrier in the gap between the photoreceptor web 110 and the concentration control roller 461 may further provided.

As described previously, the electrostatic transfer type liquid electrophotographic printer according to the present invention has the following advantages. First, because a photoreceptor web is used as a photoreceptor medium, multi-color toner images are sequentially formed on the photoreceptor web such that the toner images overlap each other. The multi-color toner images are simultaneously transferred to a print paper P. Thus, it is easy to control registration in developing and transferring the toner images.

Second, since the multi-color toner images are transferred to a print paper by a single transfer process, the print paper contacts the liquid carrier applied on the photoreceptor web just one time, so that wetness of the print paper by the liquid carrier can be minimized. Also, most of the liquid carrier is recovered in each development unit by the squeeze roller rotating in contact with the photoreceptor web, so that consumption of the liquid carrier decreases.

Third, the concentration of the overlapping toner images formed on the photoreceptor web is uniformly controlled by the concentration control unit before a transfer process, the multi-color toner images can be transferred with the same transfer efficiency.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. An electrostatic transfer type liquid electrophotographic printer comprising:

a photoreceptor web circulating around a continuous path in a circulation direction;

a main charger which charges a surface of the photoreceptor web to a predetermined potential so as to have a charged surface;

a plurality of laser scanning units (LSUs) which sequentially form a plurality of latent electrostatic images by scanning a light beam onto the charged surface of the photoreceptor web;

a plurality of development units arranged in series in the circulation direction of the photoreceptor web, which sequentially develop the plurality of latent electrostatic images into multi-color toner images with inks containing a liquid carrier and charged toner, thereby forming overlapping multi-color toner images on the photoreceptor web;

a concentration control unit which controls the concentration of the multi-color toner images to be suitable for electrostatic transfer by adjusting an amount of the liquid carrier applied to the overlapping toner images formed on the photoreceptor web; and an electrostatic transfer unit which forms an electric field between the photoreceptor web and the electrostatic transfer unit and transfers the overlapping toner images formed on the photoreceptor web to a print paper by electric force.

2. The electrostatic transfer type wet electrostatic printer of claim 1, wherein the concentration control unit is installed in a last development unit among the plurality of development units.

3. The electrostatic transfer type wet electrostatic printer of claim 2, wherein the last development unit comprises a developer roller installed to be operative to rotate while being separated by a predetermined gap from the photoreceptor web, for forming a toner image in an image region of the photoreceptor web in which a latent electrostatic image is formed, with the toner of the ink; and wherein the concentration control unit is installed following the developer roller.

4. The electrostatic transfer type liquid electrophotographic printer of claim 1, wherein the concentration control unit is spatially separated from the plurality of development units.

5. The electrostatic transfer type liquid electrophotographic printer of claim 1, wherein the concentration control unit controls the concentration of the toner images in the range of 20–40%.

6. The electrostatic transfer type liquid electrophotographic printer of claim 2, wherein the concentration control unit comprises a concentration control belt circulating by being supported by at least two rollers, the concentration control belt being installed with a predetermined separation gap from the photoreceptor web; and wherein the concentration control belt removes excess liquid carrier from the photoreceptor web, and retains an appropriate amount of liquid carrier thereon to allow the liquid carrier to permeate into the toner images.

7. The electrostatic transfer type liquid electrophotographic printer of claim 2, wherein the concentration control unit comprises a concentration control roller having a diameter at least two times larger than the diameter of the developer roller, and rotating while being separated by a predetermined gap from the photoreceptor web; and wherein the concentration control roller removes excess liquid carrier from the photoreceptor web, and retains an appropriate amount of liquid carrier thereon to allow the liquid carrier to permeate into the toner images.

8. The electrostatic transfer type liquid electrophotographic printer of claim 4, wherein the concentration control unit comprises:

a carrier reservoir for storing a liquid carrier; and a concentration control belt installed in the carrier reservoir with a predetermined separation gap from the photoreceptor web, the concentration control belt circulating by being supported by at least two rollers, and wherein the concentration control belt allows the liquid carrier supplied in the gap between the photoreceptor web and the concentration control belt to permeate into the toner images.

9. The electrostatic transfer type wet electrostatic printer of claim 8, wherein the concentration control unit further comprises a carrier supply unit for supplying the liquid carrier in the gap between the photoreceptor web and the concentration control belt.

10. The electrostatic transfer type liquid electrophotographic printer of claim 4, wherein the concentration control unit comprises:

a carrier reservoir for storing a liquid carrier; and a concentration control roller installed in the carrier reservoir to be operative to rotate while being separated by a predetermined gap from the photoreceptor web, the concentration control roller having a diameter at least two times larger than the developer roller, and wherein the concentration control roller supplies the liquid carrier in the gap between the photoreceptor web and the concentration control roller, and allows the supplied liquid carrier to permeate into the toner images.

11. The electrostatic transfer type liquid electrophotographic printer of claim 6 or 8, wherein a blade is installed in contact with a lower portion of the concentration control belt to remove a liquid carrier from a surface of the concentration control belt.

12. The electrostatic transfer type liquid electrophotographic printer of claim 6 or 8, wherein the concentration control belt circulates in an opposite direction to the circulation direction of the photoreceptor web.

13. The electrostatic transfer type liquid electrophotographic printer of claim 6 or 8, wherein the gap between the concentration control belt and the photoreceptor web is in the range of 50–100 $\mu$m.

14. The electrostatic transfer type liquid electrophotographic printer of claim 6 or 8, wherein a surface of the concentration control belt is charged to a first potential having the same polarity as the toner.

15. The electrostatic transfer type liquid electrophotographic printer of claim 7 or 10, wherein the concentration control roller rotates in an opposite direction to the circulation direction of the photoreceptor web.

16. The electrostatic transfer type liquid electrophotographic printer of claim 7 or 10, wherein the surface of the concentration control roller is charged to a first potential having the same polarity as the toner.

17. The electrostatic transfer type liquid electrophotographic printer of claim 1, further comprising a setting roller for setting shapes of the toner images formed on the photoreceptor web and passed through the concentration control unit, a surface of the setting roller being charged to a second potential having the same polarity as the toner.

* * * * *